United States Patent [19]

Sato et al.

[11] 4,132,876

[45] Jan. 2, 1979

[54] PUFFER TYPE GAS CIRCUIT BREAKER

[75] Inventors: Minoru Sato; Isao Takahashi; Takanao Kurasawa; Yoshio Yoshioka; Yukio Nakagawa, all of Hitachi, Japan

[73] Assignee: Hitachi, Ltd., Japan

[21] Appl. No.: 721,487

[22] Filed: Sep. 8, 1976

[30] Foreign Application Priority Data

Sep. 22, 1975 [JP] Japan ..... 50-113625

[51] Int. Cl.[2] ..... H01H 33/88

[52] U.S. Cl. ..... 200/148 A; 200/148 R; 200/148 H; 200/150 G

[58] Field of Search ..... 200/148 A, 150 G, 148 R, 200/148 H

[56] References Cited

U.S. PATENT DOCUMENTS

| | | | |
|---|---|---|---|
| 3,725,623 | 4/1973 | Fischer et al. | 200/148 H |
| 3,745,284 | 7/1973 | Hosokawa | 200/148 A |
| 3,839,613 | 10/1974 | Tsubaki | 200/150 G |
| 3,906,180 | 9/1975 | Glarner | 200/148 R |
| 3,985,988 | 10/1976 | Korner et al. | 200/148 R |

*Primary Examiner*—Robert S. Macon
*Attorney, Agent, or Firm*—Craig & Antonelli

[57] ABSTRACT

A puffer type gas circuit breaker comprises a first and a second arcing electrodes movable relative to each other, an insulating nozzle surrounding the second arcing electrode, a puffer device for introducing an arc-suppressing gas into the insulating nozzle to puff out the arc produced between the two arcing electrodes when the breaker is in motion for circuit breaking, and a movable shield device for relieving the concentration of an electric field at the front end of the first arcing electrode during the breaker motion for circuit breaking. When the breaker is closed and the circuit made, the movable shield device surrounds the first arcing electrode and insulating nozzle, with a predetermined gap between itself and the insulating nozzle opposite thereto, and is kept at the same potential as the first arcing electrode. The circuit breaker further includes a device for maintaining the predetermined gap and the same potential at least in the early stage of the breaker motion for current breaking.

8 Claims, 7 Drawing Figures

PUFFER TYPE GAS CIRCUIT BREAKER

BACKGROUND OF THE INVENTION

This invention relates to improvements in a puffer type gas circuit breaker which, prior to circuit breaking, compresses an arc-suppressing gas and blows the resulting high-pressure gas against the arc produced between the electrodes to extinguish the same.

The puffer type gas circuit breaker is constructed so that, before the contact opening of electrodes that produce an arc during the breaker motion for circuit breaking, a puffer cylinder and a puffer piston fitted therein are moved relative to each other thereby to compress an arc-suppressing gas, e.g., $SF_6$ gas, in the puffer cylinder, and a blast of highly compressed gas thus obtained is used to blow out the arc that results from the opening of electrode contacts.

It is customary to employ an insulating nozzle to conduct such a highly compressed arc-suppressing gas effectively to the arc occurring between the electrodes, the bore at the throat (the narrowest orifice portion) of the nozzle being made as small as possible to ensure efficient blow-out.

Accordingly, the arcing electrode that passes through the throat (e.g., a fixed electrode where the insulating nozzle is made movable) is small in diameter.

A common disadvantage of the puffer type gas circuit breakers with such slender electrodes is that the breaker motion for circuit breaking tends to invite concentration of an electric field at the free end of the particular electrode.

Especially where a small capacitive current is to be interrupted, it is sometimes done almost simultaneously with the contact opening because of the small current value and low voltage build-up rate. When the circuit is broken in this way, the first peak value of the voltage that varies within the range $\sqrt{2}E\ (1 - \cos \omega t)$ (where $\omega$ is the angular frequency of power supply, t is the time, and E is the effective line voltage value) is applied in the region of a very short distance between electrodes on the way to circuit breaking, only 0.5 cycle (on the commercial frequency basis) after the contact opening. As a result, restriking of arc can take place due to inability of withstanding the extremely high voltage with the first peak value of $2\sqrt{2}E$. Such a most objectionable phenomenon tends to occur when the concentration of an electric field at the front end of the slender arcing electrode is serious, particularly at the point of time where the distance between electrodes is very short.

In order to relieve the field concentration at the end of the arcing electrode and prevent restriking of arc, a puffer type gas circuit breaker already known in the art (from Japanese Patent Laid-open No. 25867/1973) uses a movable shield member which surrounds both the first arcing electrode and insulating nozzle and is either connected to a part of the same potential as the first arcing electrode or annularly arranged at substantially the same potential with the said electrode.

The circuit breaker of the known type is constructed to make the circuit by pressing a part of the insulating nozzle against the movable shield member and against the action of a push spring which biases the movable shield member in the circuit breaking direction. Consequently, the movable shield member strikes against the insulating nozzle, and therefore the mechanical strength of the insulating nozzle is a problem. Another disadvantage is an inadequate dielectric strength due to the fact that the movable shield member and movable main contact are connected by the periphery of the insulating nozzle.

SUMMARY OF THE INVENTION

The present invention is directed to the provision of a puffer type gas circuit breaker which is built to prevent the striking of the movable shield member against the insulating nozzle and is reliable in performance, with an improved ability of interrupting the small capacitive current.

To attain the end, the present invention provides a puffer type gas circuit breaker comprising movable shield means which, when the breaker is closed and the circuit made, surrounds both the first arcing electrode and insulating nozzle, with a given gap between itself and the insulating nozzle opposite thereto, and which is kept at the same potential as the first arcing electrode, and means for maintaining the gap and the same potential at least during the early stage of the breaker motion for circuit breaking.

DESCRIPTION OF THE PREFERRED EMBODIMENTS

Figure 1:
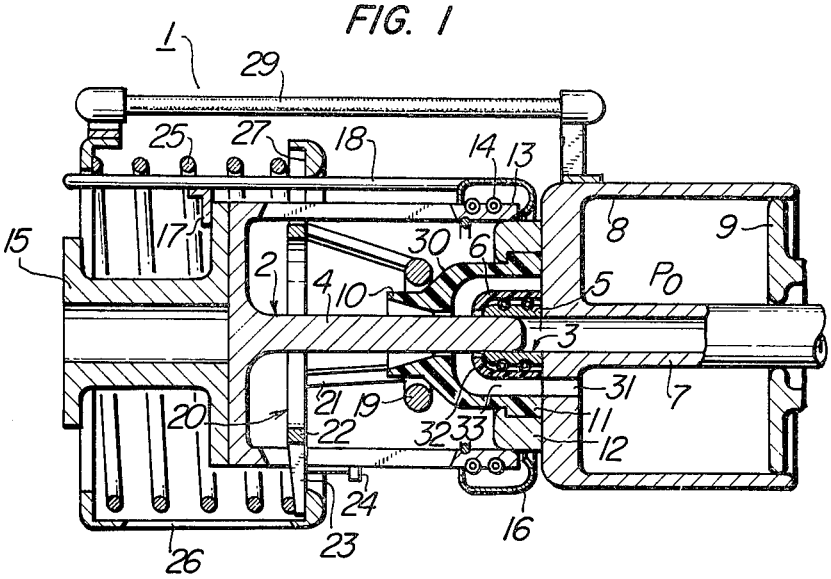
FIG. 1 is a sectional view of a puffer type gas circuit breaker embodying the invention, shown in the closed state with the circuit made.
Figure 2:
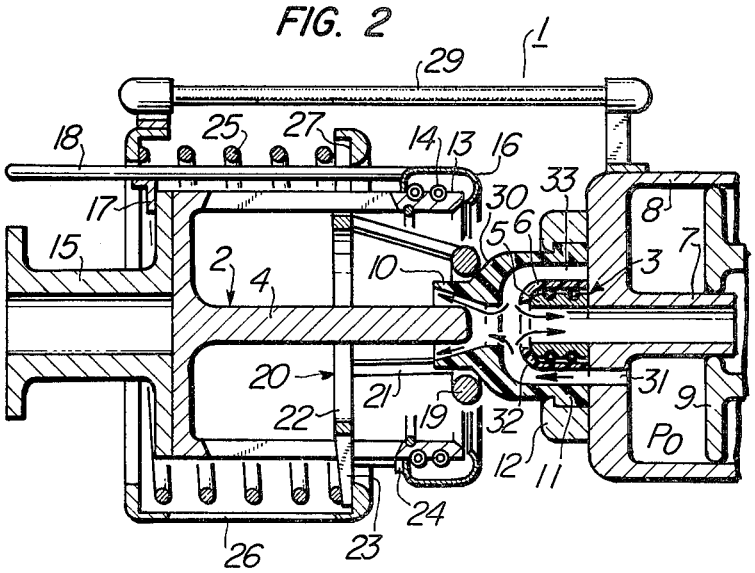
FIG. 2 is a sectional view of the breaker of FIG. 1, shown in motion for circuit breaking.
Figure 3:
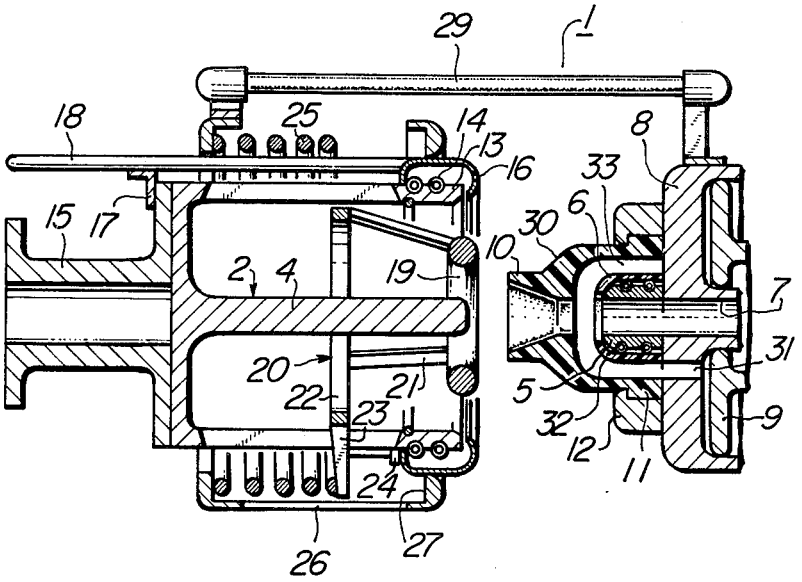
FIG. 3 is a sectional view of the breaker of FIG. 1, shown in action with the circuit broken.

The present invention will now be more fully described hereunder with reference to the accompanying drawings showing preferred embodiments thereof. In FIGS. 1 to 3 there is shown one embodiment of the puffer type gas circuit breaker of the invention in three different conditions, i.e., closed, beginning to break the circuit, and breaking, respectively. Throughout these figures the puffer type gas circuit breaker is generally indicated at 1. The circuit breaker comprises a stationary section 2 and a movable section 3. The stationary section 2 includes a first arcing electrode in the form of a bar or tube, or a fixed arcing electrode 4, and the movable section 3 includes a hollow, second arcing electrode, or a movable arcing electrode 5, opposed to the fixed electrode 4. The movable arcing electrode 5 is provided with a spring 6 for adding contact pressure, and is attached to a puffer cylinder 8, which in turn is connected to an external control not shown through a cylinder rod 7. In the puffer cylinder 8 is fitted a puffer piston 9 which is made fast to a support (not shown) including a movable conductor. An insulating nozzle 10 is secured at a mounting base 11 to the puffer cylinder 8 with the aid of a movable main contact 12 for power supply, in such a manner that the nozzle may surround the contacting portions of the both arcing electrodes 4, 5.

Around the fixed arcing electrode 4 and insulating nozzle 10 is provided an annular, fixed main contact 13 for power supply, as split into a plurality of contact pieces squeezed together by a spring 14 for contact pressure so that, when the circuit breaker is closed to make the circuit, the contact pieces bear against the movable main contact 12 for energization.

The fixed main contact 13 and the fixed arcing electrode 4 are electrically conductively connected to each other and to a stationary conductor 15. A shield 16 around the fixed main contact 13 is attached to support members 18, which in turn are supported by the stationary conductor 15 through brackets 17, so that an electrically conductive relation is established between the shield 16 and conductor 15.

In accordance with the invention, a movable shield 19 is provided in the form of a ring. The ring-shaped movable shield 19 is supported by a support assembly 20, as shown, to be located midway between the fixed arcing electrode 4 and fixed main contact 13. The support assembly 20 comprises a support member 21 connected to the movable shield 19, a support ring 22 joined to the support member 21, and an arm 23 extending radially outwardly from the support ring 22. The arm 23 is equipped with a stopper 24, which is adapted to engage the edge of the shield 16 to restrict the movement of the ring-shaped movable shield 19 toward the movable section 3.

A spring 25 adapted to engage and bias the arm 23 toward the movable section is accommodated in a precompressed state inside a holder 26, which is slidably disposed on the support members 18 of the shield 16 and is movable thereon axially of the circuit breaker. The support members 18 thus serve as guides for the holder 26. One end of the holder 26 bears against the spring 25, and the other end is adapted to engage the arm 23, providing a stopper 27 for the latter. Also, the holder 26 is integrally connected to the puffer cylinder 8 of the movable section 3 by means of an insulating connector or connectors 29. It should be noted that the position of the holder end or stopper 27, or the length of the holder, and the length of the connector or connectors 29 are so chosen that, when the circuit is made, the ring-shaped movable shield 19 is kept a predetermined distance away from the shoulder 30 of the insulating nozzle 10.

In the embodiment being described, the stationary conductor 15, support members 17, 18, holder 26, arm 23, support ring 22, and ring-shaped movable shield 19 are electrically conductively connected, in the order mentioned, so that the same potential is maintained in the ring-shaped movable shield 19 as in the stationary conductor 15.

In the puffer type gas circuit breaker constructed as above in accordance with the invention, the path of current is similar to that in a conventional breaker of the type; the current from a terminal not shown flows through the stationary conductor 15, branches into two flows, one passing through the fixed main contact 13 and movable main contact 12 and the other passing through the fixed arcing electrode 4 and movable arcing electrode 5, and they merge into the puffer cyliner 8, and thence flows to the movable conductor not shown. When the breaker is closed and the circuit made, the ring-shaped movable shield 19 is biased toward the movable section by the spring 25 through the arm 23 of the support assembly 20. Nevertheless, the predetermined gap is maintained between the shield 19 and the shoulder 30 on the outer periphery of the insulating nozzle 10 because of the combined restricting action of the connector or connectors 29 and the holder end serving as the stopper 27.

It is now assumed that the puffer cylinder 8 is driven rightward in response to an instruction for circuit breaking. The cylinder then compresses an arc-suppressing gas in the puffer chamber Po formed by the puffer cylinder 8 and puffer piston 9. The compressed gas is forced out through an admission port 31 of the puffer cylinder 8 into a passage 33 defined by a flow guide 32 surrounding the movable arcing electrode 5 and by the insulating nozzle 10. The resulting blast of gas extinguishes the arc produced when the contacts were open between the fixed arcing electrode 4 and movable arcing electrode 5. In the early stage of motion for circuit breaking, or before the arrival of the ring-shaped movable shield 19 at the neighborhood of the end of fixed electrode 4, the shield 19 follows the motion of the puffer cylinder 8 through the insulating connector or connectors 29, holder 26, arm 23, and support members 22, 21. Thus, up to this point of time, the gap between the ring-shaped movable shield 19 and the shoulder 30 of the insulating nozzle 10 is kept at the value predetermined in the closed condition of the circuit breaker.

For the breaker motion for circuit breaking, the stroke characteristic of the movable section 3 including the movable arcing electrode 5 and puffer cylinder 8 is such that, at a point of time corresponding to about one-half cycle (0.5 cycle) of the power frequency after the contact parting of the arcing electrodes 4, 5, the stopper 24 attached to the arm 23 comes into contact with the shield 16 that surrounds the fixed main contact 13, as shown in FIG. 2, and the ring-shaped movable shield 19 stops at the point where its hollow diametral center is occupied generally concentrically by the free end of the fixed arcing electrode 4.

With the progress of the circuit breaking stroke, the ring-shaped movable shield 19 will discontinue the follow-up motion because the stopper 24 makes contact with the shield 16 in the manner described, allowing the holder 26 alone to be driven toward the movable section 3 as in FIG. 3, while compressing the spring 25, to the extremity of the stroke where the circuit is completely open.

The stroke for making the circuit is the exact reverse of that for breaking. As the movable section 3 travels leftward from the position in FIG. 3, the holder 26 initially moves leftward leaving the ring-shaped movable shield 19 behind. Just before the shoulder 30 of the insulating nozzle 10 comes into contact with the movable shield 19, the stopper 27 of the holder 26 touches the arm 23 of the support assembly 20. From this point onward the ring-shaped movable shield 19 moves together with the movable arcing electrode 5 and puffer cylinder 8, while maintaining the predetermined gap between itself and the shoulder 30 of the insulating nozzle 10, until the circuit is made.

In the embodiment so far described, the ring-shaped movable shield 19 is kept out of contact with the insulating nozzle 10, and therefore the structure including the shield and nozzle is protected against the deterioration of its mechanical strength which may otherwise result from the contact. Even if the small capacitive current is interrupted at a point of the stroke where the fixed arcing electrode 4 is already away from the movable arcing electrode 5 but not sufficiently distant from each other, the electric field at the front end of the fixed arcing electrode upon application of the first peak value of the recovery voltage will be relieved by the ring-shaped movable shield 19 and restriking of arc will be effectively prevented, because the embodiment is constructed so that the diametral center of the ring-shaped movable shield 19 will be located substantially in the front end of the fixed electrode 4 in a period of time corresponding to about 0.5 cycle after the contact parting of the arcing electrodes 4, 5.

Although the puffer cylinder 8 and holder 26 in the embodiment have been described as connected by either a single connecting rod of insulating material or a plurality of such rods, it will be clear to those skilled in the art that such connector means may be replaced by an insulating cylinder or cylinders, with or without slitting.

Also, the stopper 24 for restricting the movement of the ring-shaped movable shield 19 toward the movable section may be secured to the shield 16 instead of to the arm 23 as shown, or alternatively the spacing between the contact pieces of the fixed main contact 13 may be partly narrowed down to provide a stopper which will function as 24.

Futher, while the compression spring 25 biasing the ring-shaped movable shield 19 toward the front end of the fixed arcing electrode 4 is constructed to maintain the same potential as the holder 26 and arm 23, it may be protected against striking of arc during the breaker motion for circuit breaking by inserting an insulating member in an appropriate position near the movable shield.

In this case, the same desirable effect as with the original arrangement is achieved because the potential of the ring-shaped movable shield 19 is kept at substantially the same level as that of the fixed arcing electrode 4 through the high resistance of the insulating material or the distributed capacitance between the movable shield and the stationary section.

Figure 4:
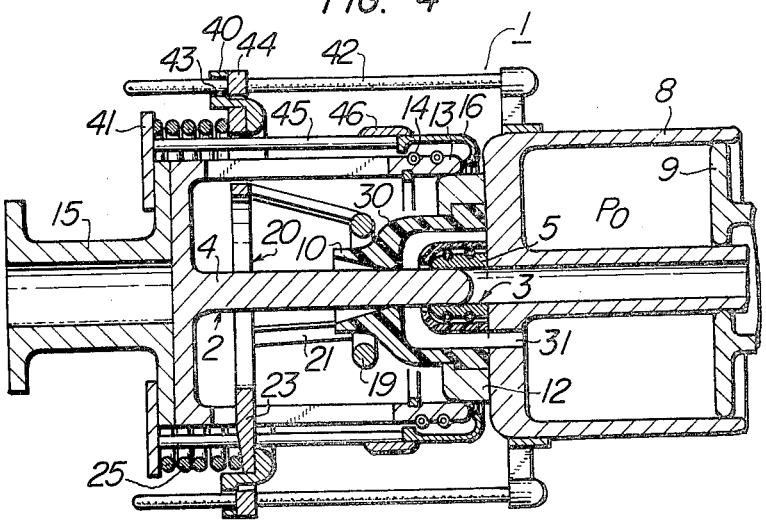
FIG. 4 is a sectional view of another embodiment of puffer type gas circuit breaker of the invention, show in the closed state with the circuit made.
Figure 5:
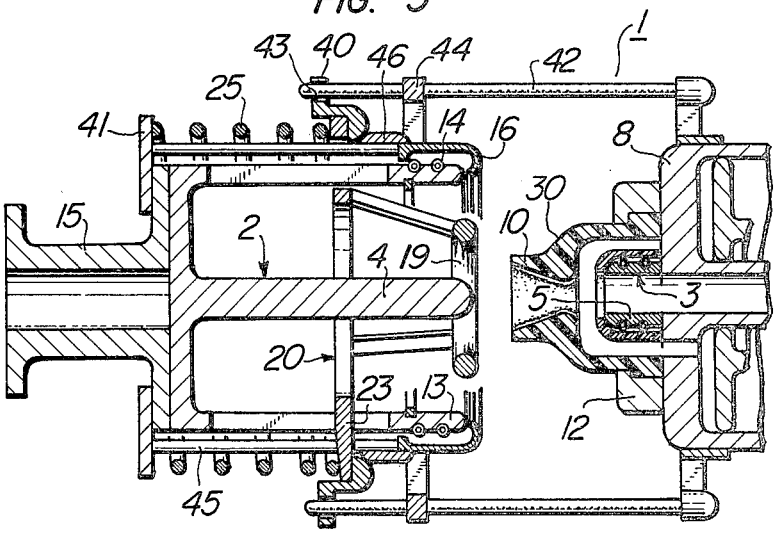
FIG. 5 is a sectional view of the breaker of FIG. 4, shown in action with the circuit broken.

Another embodiment of the invention will now be described in conjunction with FIGS. 4 and 5, in which, as well as in the preceding figures showing the first embodiment, like numerals are used to denote like parts.

The second embodiment includes a holder 40 fixed to or supported by the arm 23, so that the movable shield 19 connected to the holder 40 through the support assembly 20 can move integrally therewith. The spring 25 is held in a precompressed state between the arm 23 and an electrically conductive end plate 41 secured conductively to the stationary conductor 15. To the puffer cylinder 8 are attached a plurality of insulating guide members 42 in the form of rods extended toward the stationary section 2 and inserted into holes 43 of the holder 40. The guide members 42 are provided with stoppers 44, and the holder 40 is urged against the stoppers by the spring 25. The stoppers 44 are attached at points preselected so that, when the circuit is made (FIG. 4), the ring-shaped movable shield 19 and the shoulder 30 of the insulating nozzle are kept a predetermined distance apart. The electrically conductive end plate 41 and shield 16 are conductively connected by conductive guide members 45 is disposed a stopper 46 adapted to engage the holder 40. The location of the stopper 46 is preselected, like the length of the stopper 24 in the first embodiment, to enable the ring-shaped movable shield 19, during the breaker motion for circuit breaking, to discontinue its follow-up motion toward the movable section 3 at a point where the diametral center of the shield ring is nearly superposed with the front end of the fixed arcing electrode 4.

As the puffer cylinder 8 travels rightward on its way for circuit breaking, the insulating guide members 42 are pulled rightward. The holder 40 and therefore the ring-shaped movable shield 19 are forced to the right by virtue of the spring 25, while maintaining a constant gap between the shield 19 and insulating nozzle 10. The holder 40 then comes into contact with the stopper 46, making it no longer possible for the ring-shaped movable shield 19 to move forward. With further progress of the circuit breaking stroke, the insulating guide members 42 continue to slide through the holes 43 of the holder 40, and the movable section as a whole moves further rightward until the entire motion is over and the circuit is open (FIG. 5).

The embodiment just described above differs from the first embodiment illustrated in FIGS. 1 to 3 in that the ring-shaped movable shield 19 is driven by the spring 25 in the early stage of motion for circuit breaking. However, the effect comparable to that with the first embodiment can be attained by presetting the stroke characteristic of the movable section 3 in the early stage of the breaker motion for circuit breaking, in the same way as with the first embodiment, so that the front end of the fixed arcing electrode 4 and the diametral center of the ring-shaped movable shield 19 are substantially superposed in about a period of time corresponding to 0.5 cycle after the contact opening of the arcing electrodes 4, 5. An additional advantage of this embodiment is a saving of weight of the movable section made possible by the arrangement such that the puffer cylinder 8 is accompanied in its movement by only the insulating guide members 42 and that the ring-shaped movable shield 19 is driven by the spring 25.

While the insulating guide members 42 in the second embodiment have been illustrated as rods, they may take the form of cylinders, if desired, and may be connected to the movable section 3 by direct attachment to the linkage for actuating the movable section.

Figure 6:
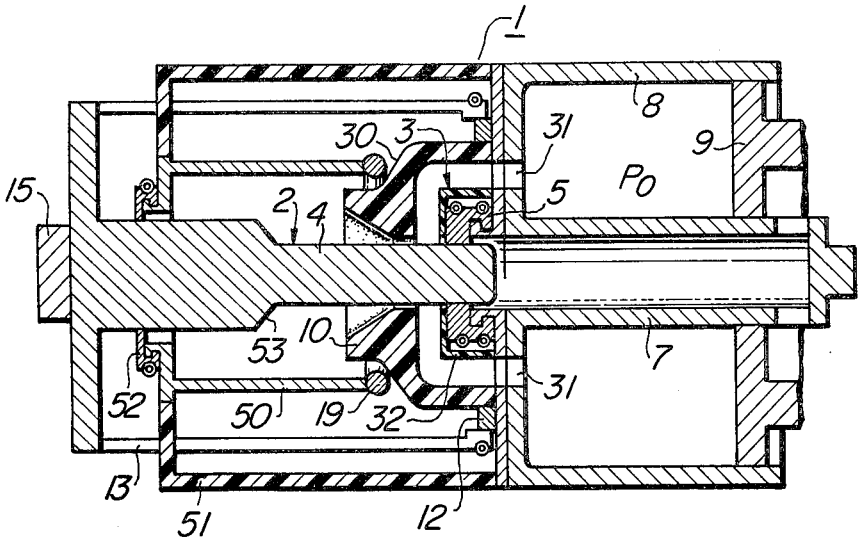
FIG. 6 is a sectional view of still another embodiment of puffer type gas circuit breaker of the invention, shown in the closed state with the circuit made.

Still another embodiment of the invention will be described below in connection with FIGS. 6 and 7.

In this embodiment the ring-shaped movable shield 19 is supported by a metallic support member 50, which in turn is connected to the puffer cylinder 8 by an insulating connector 51. The lengths of the metallic support member 50 and insulating connector are so chosen as to permit the ring-shaped movable shield 19 to face the shoulder 30 of the insulating nozzle, with a predetermined gap maintained therebetween. The metallic support member 50 is also connected to a current collector 52 in sliding contact with the fixed arcing electrode 4 to transmit the potential of the electrode 4 to the ring-shaped movable shield 19. The fixed arcing electrode 4 in sliding contact with the current collector 52 is reduced in diameter midway, providing a shoulder 53 where the conductive connection between the electrode 4 and current collector 52 is to be cut off toward the end of the breaker stroke for circuit breaking. Like the stoppers 24, 46 of the preceding embodiments, the shoulder 53 is formed in a preselected location such that the conductive connection between the said two components is broken at the point where the diametral center of the ring-shaped movable shield 19 is generally superposed with the front end of the fixed arcing electrode 4 during the circuit breaking stroke.

In the breaker motion for circuit breaking, the puffer cylinder 8 travels rightward, pulling the insulating connector 51 in the same direction. Consequently, the metallic support member 50, ring-shaped movable shield 19, and current collector 52 move altogether to the right. During this movement the shield 19 is kept a predetermined distance apart from the shoulder 30 of the insulating nozzle 10. The stroke characteristic of the movable section 3 is such that, when the current collector 52 has slid up to the shoulder 53 of the fixed arcing electrode, in the same manner as in the preceding embodiments in the early stage of circuit breaking, the front end of the electrode 4 and the diametral center of the ring-shaped movable shield 19 are substantially superposed and the current collector 52 is slid away from the shoulder 53 of the electrode 4 in a period of time corresponding to about 0.5 cycle after the contact opening of the both arcing electrodes 4, 5. Thus, in the early stage of the breaker motion for circuit breaking the ring-shaped movable shield 19 is kept at the same potential as the fixed arcing electrode 4 but, in the advanced stage of circuit breaking stroke, the conductive connection between the current collector 52 and the fixed electrode 4 is cut off and the same potential is no longer maintained. After this, the ring-shaped movable shield 19 moves further rightward together with the movable section to conclude the stroke for circuit breaking.

According to this third embodiment of the invention, the ring-shaped movable shield 19 is integrally connected to the insulating connector 51 and is constructed to maintain a predetermined gap between itself and the shoulder 30 of the insulating nozzle throughout the entire stroke for circuit breaking, the ring-shaped shield being located so that its diametral center is substantially superposed with the front end of the fixed arcing electrode 4 in a period of time corresponding to approximately 0.5 cycle after the contact opening of the both arcing electrodes 4, 5. The arrangement simplifies the construction while permitting the attainment of the same advantageous effects as with the preceding embodiments.

Although the ring-shaped movable shield 19 in the third embodiment has been illustrated as conductively connected to the fixed arcing electrode 4 via the current collector 52, it will be obvious to those skilled in the art that a potential contact rod may be employed in lieu of the collector 52 to provide the ring-shaped movable shield 19 with the same potential as that of the fixed arcing electrode 4.

Figure 7:
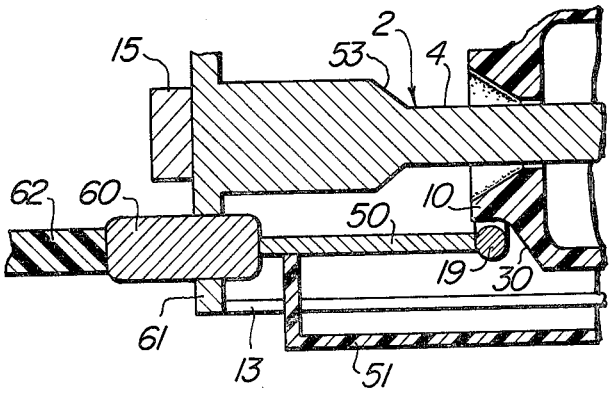
FIG. 7 is a sectional view of a modification of the breaker of FIG. 6, shown in the closed state.

The modification is exemplified in FIG. 7 where the circuit breaker is shown in a closed state. A potential contact rod 60 is conductively connected at one end to the metallic support member 50 and is slidably and conductively inserted through a hole of a member 61 kept at the same potential as the fixed arcing electrode 4. The potential contact rod 60 is connected at the opposite end to an insulating guide member 62, and is adapted to move a predetermined distance toward the circuit breaking direction where it can cut off the electrical connection between the ring-shaped movable shield 19 and fixed arcing electrode 4. In the same way as with the shoulder 53 already explained in connection with FIG. 6, the length of the potential contact rod 60 is preselected in consideration of the stroke characteristic of the movable section such that the front end of the fixed arcing electrode 4 and the diametral center of the ring-shaped shield 19 are generally superposed at a point of time corresponding to about 0.5 cycle after the contact opening of the both arcing electrodes 4, 5. Hence the same effect is achieved as with any of the preceding embodiments.

What is claimed is:

1. A puffer type gas circuit breaker comprising a first and a second arcing electrode movable relative to each other, an insulating nozzle surrounding said second arcing electrode, puffer means adapted to introduce an arc-suppressing gas into said insulating nozzle to extinguish the arc produced between said two arcing electrodes during the breaker motion for circuit breaking, movable shield means for relieving the concentration of an electric field at the front end of said first arcing electrode during the breaker motion for circuit breaking, said shield means being constructed so that, when the breaker is closed and the circuit made, said shield means surrounds said first arcing electrode and insulating nozzle and is located opposite to said insulating nozzle with a predetermined gap therebetween, said shield means being kept at the same potential as said first arcing electrode, and means for maintaining said predetermined gap and said same potential at least in the early stage of the breaker motion for circuit breaking, wherein said first arcing electrode is fixed and forms part of the stationary section of the circuit breaker while said second arcing electrode is movable and forms part of the movable section of the breaker, and said insulating nozzle is secured to the movable section so as to move integrally with said second arcing electrode, so that said means for maintaining said gap and potential causes said movable shield means to follow up the motion of said movable section, while maintaining said predetermined gap, at least in the early stage of the breaker motion for circuit breaking.

2. A gas circuit breaker according to claim 1, wherein said movable shield means is ring-shaped and said gap-and-potential maintaining means includes stopper means for stopping the follow-up motion of said ring-shaped movable shield means relative to said movable section, during the breaker motion for circuit breaking, at a point where the diametral center of said ring-shaped shield is substantially superposed with the front end of said fixed first arcing electrode.

3. A gas circuit breaker according to claim 2, wherein the stroke characteristic of said movable section during the breaker motion for circuit breaking is such that the hollow diametral center of said ring-shaped movable shield is substantially superposed with the front end of said first arcing electrode at a point of time corresponding to about one-half cycle of the power frequency after the contact opening of said first and second arcing electrodes.

4. A gas circuit breaker according to claim 1, wherein said movable shield means is ring-shaped, said first arcing electrode is in the form of a rod or tune, and said second arcing electrode is hollow and capable of receiving said first arcing electrode therein.

5. A gas circuit breaker according to claim 4, wherein said gap-and-potential maintaining means comprises a support assembly supporting said ring-shaped movable shield, a compression spring engaged with said support assembly to bias the same toward said movable section, a holder holding said compression spring in a compressed state, said holder being engaged at one end with said support assembly under the urging of said compression spring, whereby said ring-shaped movable shield is enabled to maintain said predetermined gap, a connector or connectors connecting said holder to said movable member for integral movement, and guide members secured to the stationary section for slidably guiding said holder, said guide members having stoppers engageable with said support assembly so that, after the ring-shaped movable shield has followed up the motion of the movable section while maintaining the predetermined gap therebetween in the early stage of the breaker motion for circuit breaking, the ring-shaped movable shield is no longer allowed to follow up.

6. A gas circuit breaker according to claim 4, wherein said gap-and-potential maintaining means comprises a support assembly supporting said ring-shaped movable shield, a compression spring engaged at one end with said stationary means and at the other end with said support assembly to bias the same toward said movable section, a holder engaged with said support assembly under the urging of said compression spring whereby its motion under the urging of said spring is restricted, first guide members connected to said movable section for guiding said holder, said guide members having first stoppers engaged with said holder to keep said holder from moving toward the movable section along said guide members under the urging of said compression spring, whereby said ring-shaped movable shield is enabled to maintain said predetermined gap, and second guide members secured to said stationary section for guiding said holder and having second stoppers engageable with said holder, so that, after the ring-shaped movable shield has followed up the motion of the movable section while maintaining the predetermined gap therebetween in the early stage of the breaker motion for circuit breaking, the ring-shaped movable shield is no longer allowed to follow up.

7. A gas circuit breaker according to claim 4, wherein said gap-and-potential maintaining means comprises conductive support means for supporting said ring-shaped movable shield, current collector means for conductively connecting said conductive support means slidably to the base of said first arcing electrode, and a connector for connecting said conductive support means and current collector means to be integrally movable with said movable section, said base of first arcing electrode being formed with a shoulder which will release said current collector means from the conductive connection after said ring-shaped movable shield has been maintained at the same potential as said first arcing electrode in the early stage of the breaker motion for current breaking.

8. A puffer type gas circuit breaker comprising a first and a second arcing electrode movable relative to each other, an insulating nozzle surrounding said second arcing electrode, puffer means adapted to introduce an arc-suppressing gap into said insulating nozzle to extinguish the arc produced between said two arcing electrodes during the breaker motion for circuit breaking, movable shield means for relieving the concentration of an electric field at the front end of said first arcing electrode during the breaker motion for circuit breaking, said shield means being constructed so that, when the breaker is closed and the circuit made, said shield means surrounds said first arcing electrode and insulating nozzle and is located opposite to said insulating nozzle with a predetermined gap therebetween, said shield means being kept at the same potential as said first arcing electrode, and means for maintaining said predetermined gap and said same potential at least in the early stage of the breaker motion for circuit breaking, wherein said insulating nozzle includes a nozzle portion with a first outer diameter, a base portion with a second larger outer diameter, and a shoulder portion connecting said nozzle portion to said base portion, and wherein said shield means includes an annular structure having an inner diameter larger than said first outer diameter and smaller than said second larger diameter, said shield means being maintained at said predetermined gap from said shoulder portion of said insulating nozzle at least in said closing position and in early stages of breaker motion for circuit breaking.

* * * * *